US009105983B2

(12) United States Patent
Pintos et al.

(10) Patent No.: US 9,105,983 B2
(45) Date of Patent: Aug. 11, 2015

(54) METHOD FOR PRODUCING AN ANTENNA, OPERATING IN A GIVEN FREQUENCY BAND, FROM A DUAL-BAND ANTENNA

(75) Inventors: Jean-François Pintos, Saint Blaise du Buis (FR); Jean-Yves Le Naour, Pace (FR); Philippe Minard, Saint-Medard sur Ille (FR)

(73) Assignee: Thomson Licensing (FR)

( * ) Notice: Subject to any disclaimer, the term of this patent is extended or adjusted under 35 U.S.C. 154(b) by 834 days.

(21) Appl. No.: 13/138,541

(22) PCT Filed: Feb. 24, 2010

(86) PCT No.: PCT/FR2010/050309

§ 371 (c)(1),
(2), (4) Date: Dec. 1, 2011

(87) PCT Pub. No.: WO2010/100365

PCT Pub. Date: Sep. 10, 2010

(65) Prior Publication Data

US 2012/0098722 A1 Apr. 26, 2012

(30) Foreign Application Priority Data

Mar. 5, 2009 (FR) ..... 09 51398

(51) Int. Cl.
*H01Q 13/10* (2006.01)
*H01Q 1/38* (2006.01)
(Continued)

(52) U.S. Cl.
CPC ..... *H01Q 13/085* (2013.01); *H01Q 1/38* (2013.01); *H01Q 5/335* (2015.01)

(58) Field of Classification Search
USPC ..... 343/767, 797, 700 MS, 770, 795, 786
IPC ..... H01Q 1/38,5/335, 13/085
See application file for complete search history.

(56) References Cited

U.S. PATENT DOCUMENTS 5,541,611 A 7/1996 Peng et al.
6,417,809 B1 7/2002 Kadambi et al.
(Continued)

FOREIGN PATENT DOCUMENTS

EP 0401978 12/1990
EP 1494316 1/2005
(Continued)

OTHER PUBLICATIONS

Horng-Dean Chen et al: "Band-notched ultra-wideband square slot antenna" Microwave and optical technology letters Wiley USA, vol. 48, No. 12, Dec. 2006, pp. 2427-2429.
Search Report Dated Jun. 2, 2010.
Vergerio et al., "Design of multiple antennas at 5 GHz for mobile phone and its MIMO performances", 2007 International Conference on Electromagnetics in Advanced Applications, Torino, Italy, Sep. 17, 2007, pp. 65-68.
(Continued)

*Primary Examiner* — Karl D Frech
(74) *Attorney, Agent, or Firm* — Jack Schwartz & Associates, PLLC

(57) ABSTRACT

The present invention relates to a method for producing an antenna operating in a given frequency band, from a dual-band antenna. According to the method, the dual-band antenna is a broadband slot antenna that receives and/or transmits electromagnetic signals at a first frequency and at a second higher frequency. The antenna is powered by a single power supply line, and the free end of the power supply line is connected, by a connection means that can be opened or closed, to at least one means for rejecting one of the frequencies. This invention can be used in producing generic electronic boards.

14 Claims, 3 Drawing Sheets

(51) Int. Cl.
*H01Q 5/335* (2015.01)
*H01Q 13/08* (2006.01)

(56) References Cited

U.S. PATENT DOCUMENTS

| | | | |
|---|---|---|---|
| 2002/0075195 | A1 | 6/2002 | Powell et al. |
| 2002/0140612 | A1 | 10/2002 | Kadambi et al. |
| 2004/0113841 | A1 | 6/2004 | Louzir et al. |
| 2006/0208954 | A1 | 9/2006 | Han et al. |
| 2007/0069955 | A1 | 3/2007 | McCorkle |
| 2008/0284667 | A1 | 11/2008 | Mercer |

FOREIGN PATENT DOCUMENTS

| | | |
|---|---|---|
| FR | 2821503 | 8/2002 |
| FR | 2873857 | 2/2006 |
| WO | WO2005099040 | 10/2005 |
| WO | WO2006018567 | 2/2006 |
| WO | WO2007063066 | 6/2007 |

OTHER PUBLICATIONS

St.-Denis et al., "A slotted waveguide applicator for continuous flow grain Drying", Journal of Microwave Power and Electromagnetic Energy, vol. 36, No. 1, 2001, pp. 3-16.

Maejima et al., "A 120-degree sector beam from a transverse slot on the corner of a triangular waveguide for a base station antenna in millimeter-wave subscriber radio system", IEEE Antennas and Propagation Society International Symposium, vol. 2, 2003, pp. 960-963.

Loui et al., "A dual-band dual-polarized nested Vivaldi slot array with multilevel ground plane", IEEE Transactions on Antennas and Propagation, vol. 51, No. 9, Sep. 2003, pp. 2168-2175.

Thaysen et al., "Mutual coupling between identical planar inverted-F", AEU-International Journal of Electronics and Communications, vol. 61, No. 8, Sep. 2007, pp. 540-545.

Carrasco et al., "Mutual coupling between planar inverted-F antennas", Microwave and Optical Technology Letters, vol. 42, No. 3, Aug. 5, 2004, pp. 224-227.

METHOD FOR PRODUCING AN ANTENNA, OPERATING IN A GIVEN FREQUENCY BAND, FROM A DUAL-BAND ANTENNA

This application claims the benefit, under 35 U.S.C. §365 of International Application PCT/FR2010/050309, filed Feb. 24, 2010, which was published in accordance with PCT Article 21(2) on Sep. 10, 2010 in French and which claims the benefit of French patent application No. 0951398, filed Mar. 5, 2009.

The present invention relates to a method for producing an antenna operating in a given frequency band, from a dual-band antenna as well as an antenna system using said method.

The development of wideband wireless networks allows several standards to cohabit. The standard IEEE802.11a is known for operation in the frequencies band located around 5 GHz but so also are the standards IEEE802.11b and IEEE802.11g for operation in the frequency bands located around 2.4 GHz. The vocation of these standards is to define the common communication rules between different device types.

As a result, communication devices currently on the market often assure a multi-standard compatibility. There is therefore a growing demand for electronic boards comprising circuits and antennas able to receive corresponding signals, that can operate in different frequency bands.

However, having as many antennas as there are usable frequency bands can not be considered if the aim is to produce a compact device.

In order to respond to this demand, it was notably proposed in the French patent application no. 2857165 in the name of THOMSON Licensing, an antenna operating in two frequency bands and having two separate accesses. In this case, each access corresponds to a reception and/or a transmission in a determined frequency band and it is necessary to have interfacing means that enable the selection and the transmission of signals in said determined band of frequencies.

There is currently a requirement to develop a generic electronic board supporting the set-up of all or some wireless functions without having to redimension the antennas.

The present invention thus relates to a method for producing an antenna operating in a given frequency band, from a dual-band or wideband antenna. As a result, it is possible to have boards on which a system of antennas can operate according to different standards and to implement, according to the standard selected, a specific antenna.

The present invention thus relates to a method for implementing an antenna operating in a given band of frequencies using a dual-band antenna, the dual-band antenna being a wideband antenna of slot type receiving and/or transmitting electromagnetic signals at a first frequency and at a higher second frequency, the antenna being powered by a single power supply line, characterized in that the free end of the power supply line is connected via the intermediary of a connection means that can be opened or closed to a means of rejection for one of the frequencies.

According to a preferred embodiment, the dual-band antenna is constituted by a tapering slot at the level of its radiating end such as a Vivaldi antenna or more usually a TSA (Tapered Slot Antenna). The power supply line is a microstrip line and the rejection means comprises a section of microstrip line. In this case, the line section is connected via a connection element forming a short-circuit at the open circuit end of the power supply microstrip line. The electrical length of the set constituted of the line section, the connection element forming a short-circuit and the part of the power supply line located after the line/slot transition is selected so that $L=\lambda g/4$ where $\lambda g$ is the guided wavelength in the lines at the rejection frequency.

The present invention also relates to an antenna system comprising at least one dual-band antenna that can be transformed into an antenna functioning in a given frequency band, according to the method described above. The use of this method enables having several possible configurations based on a single electronic board.

Other characteristics and advantages of the present invention will emerge upon reading the following description made with reference to the annexed drawings, wherein.

First will be described with reference to FIG. 1, a diagrammatic representation of a dual-band antenna able to receive and/or transmit electromagnetic signals at a first frequency, that is in a frequency band around 2.4 GHz and, a second frequency, that is in the frequency band around 5 GHz.

Figure 1:
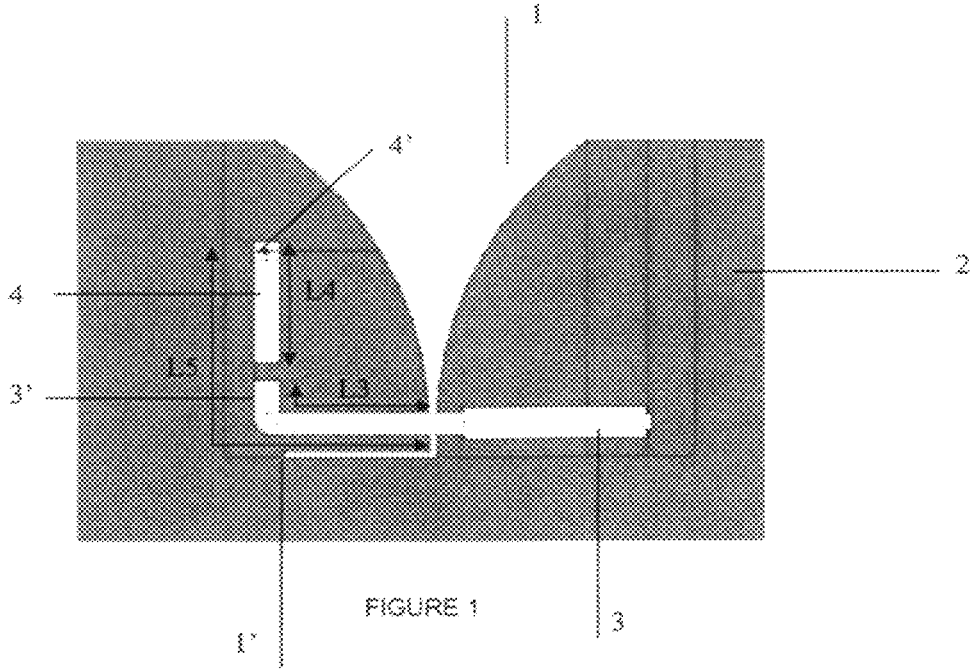
FIG. 1 is a diagrammatic top view of a dual-band antenna that can be transformed into an antenna operating in a given band of frequencies in accordance with the invention.

The antenna shown in FIG. 1 is a tapered slot antenna 1, more specifically an antenna known as a Vivaldi antenna. In a way known to those skilled in the art, this antenna is obtained by engraving a tapered slot on a substrate found on one of the sides of the ground plane 2 in which the slot is produced 1.

The substrate is, for example, an FR4 substrate of relative permitivity $\epsilon r=4.4$ and of a thickness of 1.4 mm. The slot 1 is tapered at the level of its radiating end and the dimensions of the slot, in this case the width of the tapering, the length of the slot and the curvature radius, are selected so as to have a bandwidth that encompasses the two frequency bands 2.4 GHz and 5 GHz corresponding to the standards IEEE802.11a, b and g.

In a way known to those skilled in the art, the Vivaldi antenna 1 is powered via an electromagnetic coupling via a power supply line 3 connected to electromagnetic signal transmission and reception circuits, not shown. This power supply line 3 is constituted, in the embodiment shown, by a microstrip line 3 produced on the side of the substrate opposite the metallised side 2. It crosses the slot of the Vivaldi antenna so that its free end 3' is in open circuit while the end 1' of the slot 1 is in a short-circuit. The length L3 defines the length of the microstrip line 3' between its end in open circuit and the transition plane between the slot line 1 and the microstrip line 3.

Moreover, as shown in FIG. 1, a microstrip line section 4 is produced in the prolongation of the free end 3' of the power supply line 3. This microstrip line section 4 is of length L4. L4 is selected as being the sum of L4+L3+L5 or $\cong\lambda g/4$ where $\lambda g$ corresponds to the desired rejection frequency, namely 2.4 GHz in the embodiment. L5 corresponds to the electrical length of the space between the end 3' of the power supply line and the end of the line section 4, this space being intended to receive a connection element that can be opened or closed, namely an element forming a short-circuit, for a certain frequency band as explained hereafter. As shown in FIG. 1, the other end 4' of the line section 4 is connected by a via or connected to the ground plane.

Now with reference to FIG. 2, the method in accordance with the present invention will be described that enables the dual-band antenna of FIG. 1 to be transformed into an antenna operating only on the frequency band around the second frequency, namely 5 GHz in the embodiment shown.

Figure 2:
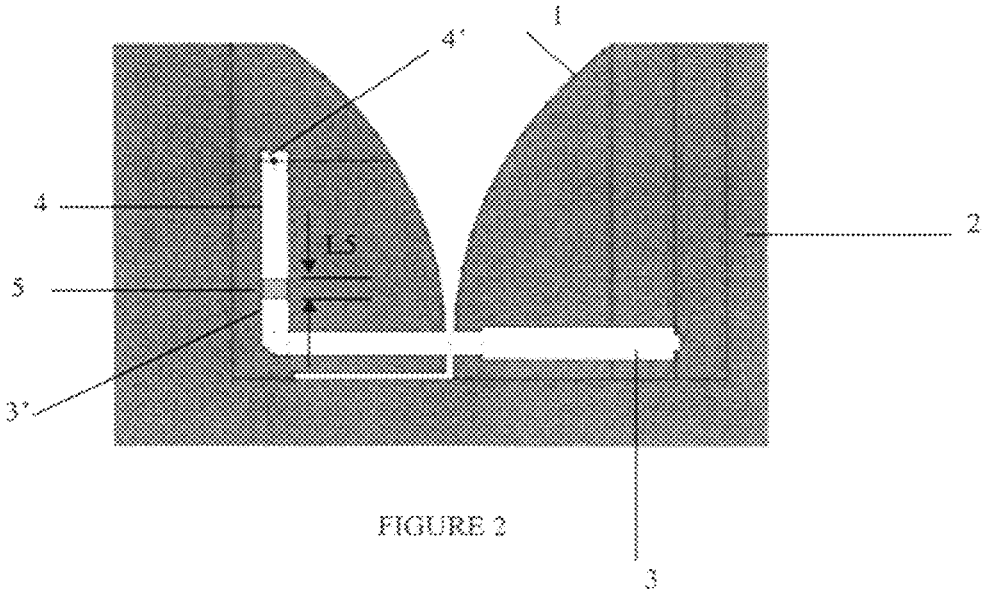
FIG. 2 is a diagrammatic top view showing an antenna operating in a given frequency band obtained with the method of the present invention.

In FIG. 2, the elements identical to those of FIG. 1 have the same references and will not be described again in detail hereafter.

In accordance with the present invention, to produce an antenna operating in a given band of frequencies from the dual-band antenna of FIG. 1, the end 3' of the power supply microstrip line 3 is connected via a connection element forming a short-circuit 5 to the section 4 of the line. This element is an RF short-circuit that can be produced via a resistance of the value of 0 Ohm or also by a capacity dimensioned so that its impedence is quasi-null at the frequency to be rejected, namely 2.4 GHz in the embodiment shown. As mentioned above, the sum of lengths L4, L3 and L5 is noticeably equal to $\lambda g/4$. This set forms a rejection element enabling the first frequency to be filtered, namely 2.4 GHz and, consequently, the Vivaldi antenna operates like a monoband antenna at 5 GHz.

Antennas such as those shown in FIGS. 1 and 2 have been simulated using an electromagnetic application based on the method of moments.

Figure 3:
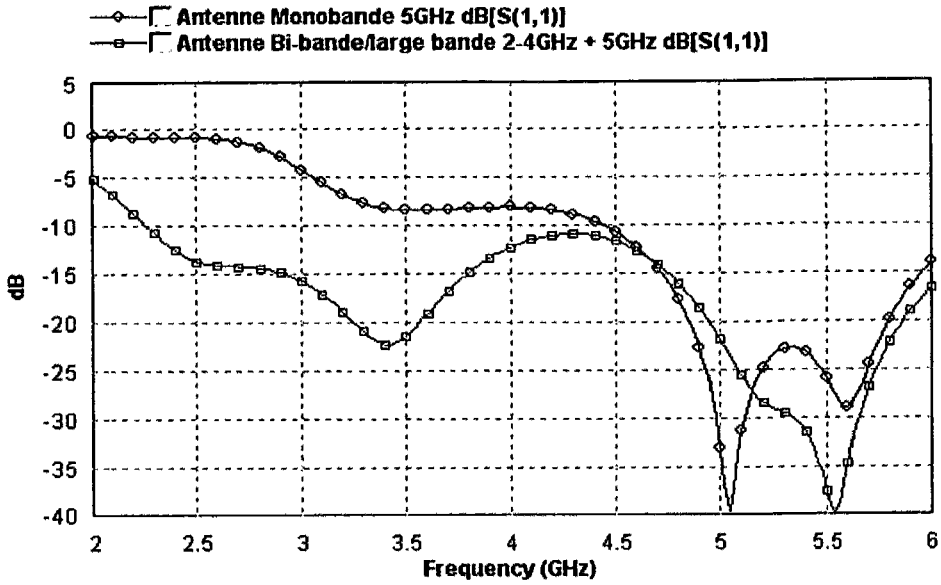
FIG. 3 shows the impedance matching curve on 50 Ohms according to the respective frequency of the antenna operating in a given band of frequencies and of the dual-band antenna.

FIG. 3 shows the impedance matching curve on 50 Ohms according to the frequency of the antenna operating in a given band of frequencies (FIG. 2) and of the dual-band antenna (FIG. 1). The antenna operating in a given frequency band has a matching better than −15 dB in the 5 GHz frequency band while its matching in the 2.4 GHz frequency band is only −0.85 dB. The antenna operating in a given frequency band is quite mismatched in the 2.4 GHz band.

The dual-band/wideband antenna is properly matched in the two frequency bands 2.4 and 5 GHz with a level respectively better than −13 dB and −15 dB.

Figure 4:
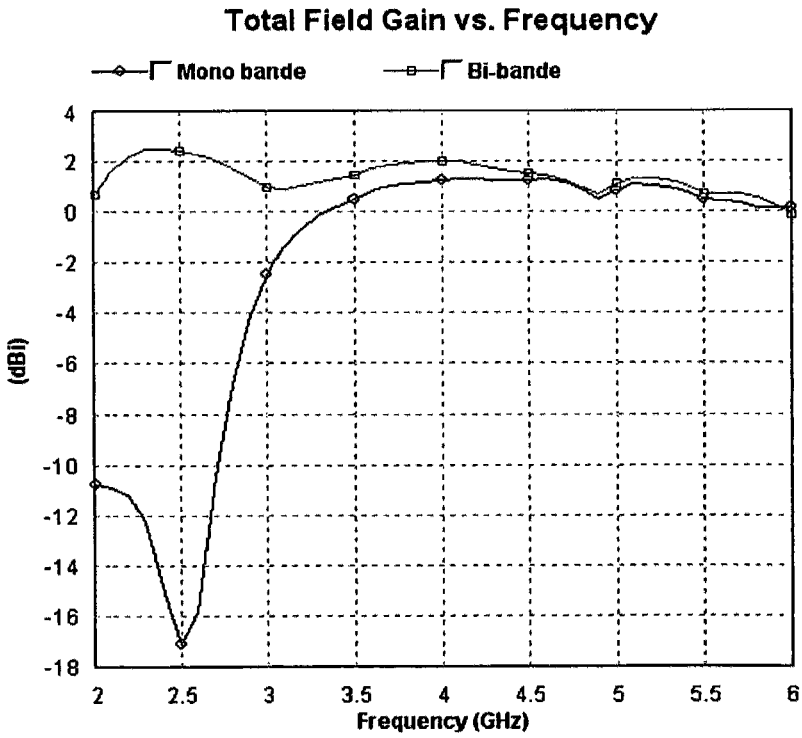
FIG. 4 shows the gain curve according to the respective frequency of the antenna operating in a given band of frequencies and of the dual-band antenna.

FIG. 4 shows the curve giving the maximum gain according to is the frequency of the antenna operating in the given frequency band and of the dual-band antenna simulated with the same application as previously. On reading these two curves, it is seen that the gain of the antenna operating in a given frequency band is positive in the 5 GHz band, while this collapses in the 2.4 GHz band. The maximum gain of the dual-band/wideband antenna is positive in the two frequency bands 2.4 and 5 GHz.

Figure 5:
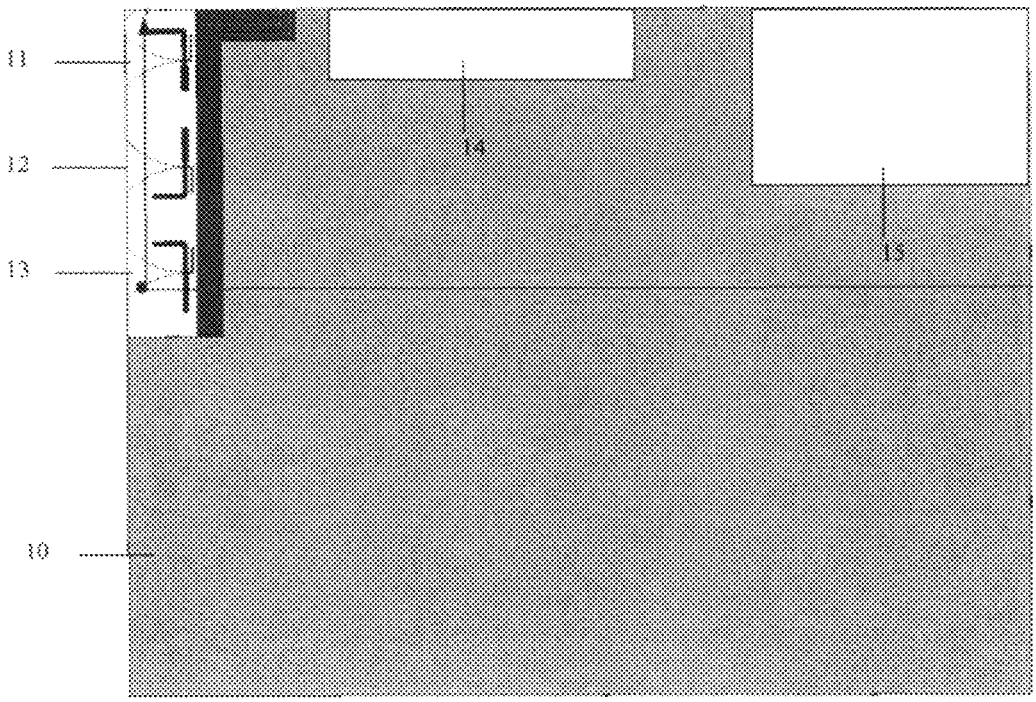
FIG. 5 is a diagrammatic top view showing a system of three antennas implemented according to the present invention.

In FIG. 5, a system of antennas constituted of three antennas 11, 12 and 13 each implemented according to the method described above is shown on an electronic board 10. Thus, each of the antennas 11, 12 and 13 can be designed to operate either in dual-band or in operating in a given frequency band according to the type of device in which the electronic board 10 is to be integrated. This enables WIFI antennas to be customised from a standard board, as explained hereafter.

An electronic board comprises, for example, three wireless systems. The 1st system is composed of 3 antennas 11, 12, and 13 as described above. This first system can operate at a first and at a second frequency f1 and f2. The second system 14 operates at a frequency f1. The third system 15 operates at a frequency f3.

With the first system, it is possible to operate according to several configurations without having to redimension the antennas. Thus a first configuration will use two RF circuits no. 1 and no. 2 operating respectively in the frequency bands f1 and f2. In order to enable a simultaneous operation, a system of no. 1 and no. 2 antennas is dedicated to each of the RF circuits operating respectively in the frequency bands f1 and f2 only. A second configuration will use a single RF circuit, namely the circuit no. 1, the circuit no. 2 not being implemented on the electronic board. This no. 1 RF circuit will operate in the two frequency bands f1 and f2. The no. 1 antenna system associated with the no. 1 RF circuit must now operate in the two frequency bands f1 and f2.

In this case, the antennas of the no. 1 antenna system must on the one hand operate in a frequency band f1 only and reject the frequency f2 for the no. 1 configuration and on the other hand, must operate both in the frequency band f1 and f2 for the no. 2 configuration.

The antennas produced according to the method of the present invention are particularly well adapted for generic electronic boards as described above.

It is evident to those skilled in the art that different modifications can be made to the embodiments described above. Several line sections of different lengths can be considered that can be connected to the end in open circuit of the power supply line, the section being selected according to the frequency that is to be rejected

The invention claimed is:

1. Method for implementing an antenna operating in a given band of frequencies using a wideband antenna, the method comprising providing a slot type wideband antenna for receiving and/or transmitting electromagnetic signals within a wide frequency band, the antenna comprising a power supply line having one free end, a rejection line for rejecting frequencies included in said wide frequency band and a connector inserted between the free end of the power supply line and the rejection line, and switching the connector between a closed state providing a short circuit between the rejection line and the power supply line to enable the antenna to reject the frequencies included in said wide frequency band and an open state in which the rejection line is not connected to the power supply line enabling the antenna to operate as a dual band antenna.

2. Method according to claim 1, wherein the wideband antenna comprises a slot tapered at the level of its radiating end, said wideband antenna comprising an antenna selected from the group constituted of a Vivaldi antenna and a TSA (Tapered Slot Antenna) antenna.

3. Method according to claim 1, wherein the power supply line is a microstrip line.

4. Method according to claim 1, wherein the rejection line comprises a section of microstrip line.

5. Method according to claim 1, wherein the connector comprises an element forming a short-circuit.

6. Method according to claim 1, wherein a length of a set including the rejection line, the connector in short circuit and a length of said power supply line between its open end and a transition plane with the slot is equal to $\lambda g/4$ where $\lambda g$ is the guided wavelength at the rejection frequency.

7. An antenna system comprising at least one dual-band antenna that can be transformed into an antenna operating in a given band of frequencies wherein the antenna is implemented by providing a slot type wideband antenna for receiving and/or transmitting electromagnetic signals within a wide frequency band, the comprising a power supply line having one free end, a rejection line for rejecting frequencies included in said wide frequency band and a connector inserted between the free end of the power supply line and the rejection line, and switching the connector between a closed state providing a short circuit between the rejection line and the power supply line to enable the antenna to reject the frequencies included in said wide frequency band and an open state in which the rejection line is not connected to the power supply line enabling the antenna to operate as a dual band antenna.

8. An antenna operable as a dual band antenna or a monoband antenna, the antenna comprising a slot type wideband antenna for receiving and/or transmitting electromagnetic signals within a wide frequency band, a power supply line for supplying power to the antenna, the power supply line having a free end, a rejection line for rejecting frequencies included in said wide frequency band, and a connector inserted between the free end of the power supply line and the rejection line, the connector being switchable between a closed state providing a short circuit between the rejection line and the power supply line to enable the antenna to reject the frequencies included in said wide frequency band and an open state in which the rejection line is not connected to the power supply line enabling the antenna to operate as a dual band antenna.

9. The antenna according to claim 8, wherein the wideband antenna comprises a slot tapered at the level of its radiating end, and is selected from the group constituted of a Vivaldi antenna and a TSA (Tapered Slot Antenna) antenna.

10. The antenna according to claim 8, wherein the power supply line is a microstrip line.

11. The antenna according to claim 8, wherein the rejection line comprises a section of microstrip line.

12. The antenna according to claim 8, wherein the connector comprises an element forming a short-circuit.

13. The antenna according to claim 8, wherein a length of a set including the rejection line, the connector and a length of said power supply line between its open end and a transition plane with the slot is equal to $\lambda g/4$ where $\lambda g$ is the guided wavelength at the rejection frequency.

14. An electronic board comprising at least one antenna, said at least one antenna operable as a dual band antenna or a monoband antenna, said at least one antenna comprising a slot type wideband antenna for receiving and/or transmitting electromagnetic signals within a wide frequency band, a power supply line for supplying power to the antenna, the power supply line having a free end, a rejection line for rejecting frequencies included in said wide frequency band, and a connector inserted between the free end of the power supply line and the rejection line, the connector being switchable between a closed state providing a short circuit between the rejection line and the power supply line to enable the antenna to reject the frequencies included in said wide frequency band and an open state in which the rejection line is not connected to the power supply line enabling the antenna to operate as a dual band antenna.

* * * * *